United States Patent [19]

Rief

[11] Patent Number: 4,683,599

[45] Date of Patent: Aug. 4, 1987

[54] AUTOMATIC POOL CLEANER FITTING

[75] Inventor: Dieter Rief, Krugersdorp, South Africa

[73] Assignee: FAHET NV, Curacao, Netherlands Antilles

[21] Appl. No.: 718,231

[22] Filed: Apr. 1, 1985

[30] Foreign Application Priority Data

Mar. 30, 1984 [ZA] South Africa ..... 84/2409

[51] Int. Cl.[4] ..... E04H 3/20

[52] U.S. Cl. ..... 4/490; 137/513.5; 137/543.15

[58] Field of Search ..... 4/490; 137/513.5, 543.15; 251/205

[56] References Cited

U.S. PATENT DOCUMENTS

| | | | |
|---|---|---|---|
| 1,934,758 | 11/1933 | Temple | 137/117 |
| 3,359,998 | 12/1967 | Fike | 137/543.15 X |
| 3,931,830 | 1/1976 | Gritz | 137/513.5 X |
| 4,378,254 | 3/1983 | Chaurier | 4/490 X |

*Primary Examiner*—Charles E. Phillips

*Attorney, Agent, or Firm*—Birch, Stewart, Kolasch & Birch

[57] ABSTRACT

An underwater fitting is provided to allow a controlled leak of water into a suction line between a filter installation and an automatic pool cleaner. The fitting is T shaped with the head of the T in the suction line and the leg of the T controlled by a tapered mandrel in an orifice which are adjustable to vary the effective orifice area. The mandrel is spring biased so that is can be pushed back in case of a complete stoppage of flow from the cleaner.

3 Claims, 2 Drawing Figures

AUTOMATIC POOL CLEANER FITTING

BACKGROUND TO THE INVENTION

This invention relates to an automatic pool cleaner fitting.

Automatic suction pool cleaners are becoming common place. Such cleaners are connected to the suction side of a filter and have means which cause them to move about the underwater surfaces of a pool while the suction is on. In some cases filters have been fitted with pumps which provide a suction force which is too high for effective operation of the cleaner or so strong that the cleaner eventually gets damaged in use.

It is an object of the invention to provide a fitting which could be used to limit the suction force acting on a cleaner.

SUMMARY OF THE INVENTION

According to the invention a fitting for underwater use in a suction line between a pool filter pump and an automatic suction cleaner has a variable orifice constantly open to water outside of the suction line.

The fitting may have a tapering mandrel positioned in the orifice, the relative positions between the mandrel and the plane of the opening being adjustable.

In one form of the invention the orifice is round and provided with a screwed ring which defines the orifice around the mandrel.

The mandrel may be spring biased to its adjusted relative position from the inside of the fitting so that it can be moved back when the interior pressure drops to a predetermined level below the outside water pressure.

According to another aspect of the invention a swimming pool cleaning installation comprises a pump, a filter, an automatic underwater cleaner and a suction line between the cleaner and the pump with the improvement of an underwater fitting which has a variable orifice constantly open to the water outside the suction line.

The suction line may connect with a skimmer box interposed between the pool and the filter and the fitting is then positioned in the skimmer box.

DESCRIPTION OF AN EMBODIMENT

Figure 1:
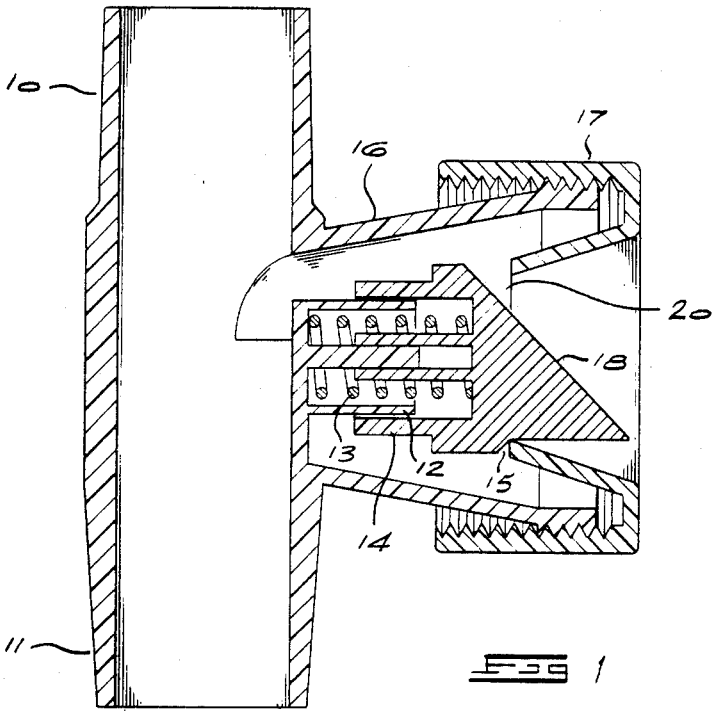
FIG. 1 is a cross-sectional view through a fitting according to the invention.
Figure 2:
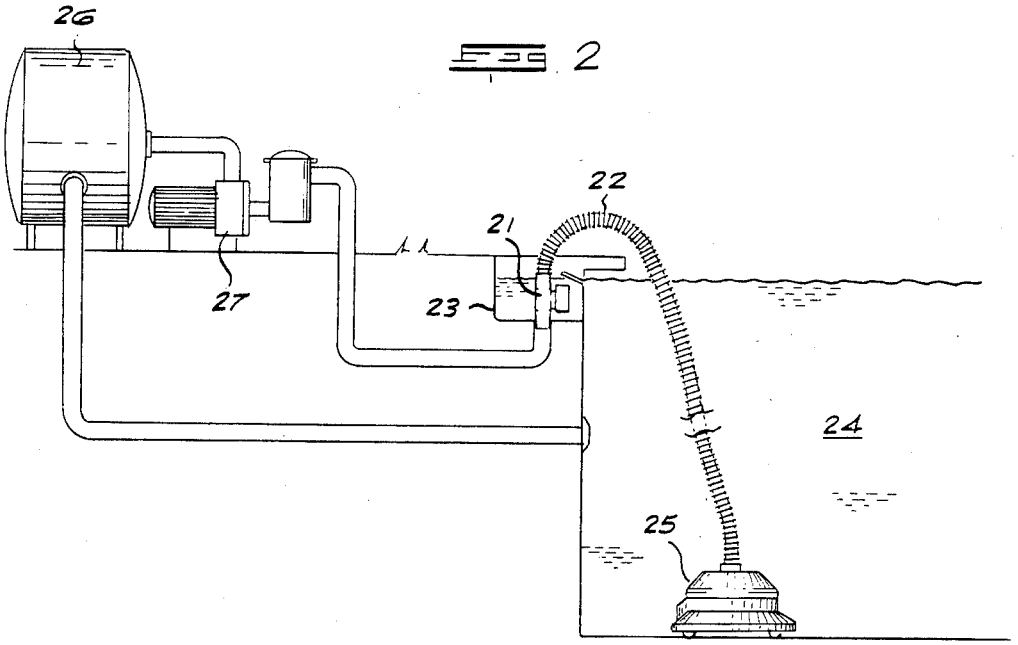
FIG. 2 is a diagrammatic illustration of the fitting in use.

The illustrated embodiment is essentially a T-piece which can be incorporated in a suction line by means of the head parts 10 and 11. The leg 16 of the T carries a hollow socket 12 in which there is housed a spring 13. A hollow mandrel 14 is fit over the socket 12 and has a shoulder 15 part of the way around it.

The mouth of the leg 16 is externally threaded and an annular member 17 is adapted to screw over it. The member 17 has a hole fitting around the mandrel 14 and is a loose fit on the shoulder 15. The forward face 18 of the mandrel 14 is formed with a slope as shown in the drawing. The slope starts behind the shoulder 15 so that with the member 17 in contact with the shoulder 15 there is still a lunate orifice 20 open to the outside. The size of the orifice 20 may be adjusted by screwing the member 27 in or out as the case may be.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A swimming pool cleaning installation including a pump, a filter, an automatic underwater cleaner, and a suction line between the cleaner and the pump, wherein the improvement comprises:

an underwater fitting located in the suction line and having a flow through head portion along a main water flow path of the suction line;

the underwater fitting including, a leg portion projecting from said head portion, an adjustable member engaged with the leg portion for defining a constantly open orifice therein, and a spring biased member positioned within the leg portion, the spring biased member being responsive to variable water pressure through the suction line for automatically adjusting the constantly open orifice to compensate for the variable water pressure, the adjustable member being threadably engaged with the leg portion and being manually adjustable to provide an initial orifice opening compatible with the suction capability of the cleaner to prevent damage thereto.

2. The swimming pool cleaning installation according to claim 1 wherein the suction line connects with a skimmer box interposed between the pool and the filter and wherein said fitting is positioned in the skimmer box.

3. A swimming pool cleaning installation according to claim 1, wherein said spring biased member is a mandrel having an angular forward face.

* * * * *